US006238229B1

(12) United States Patent
Watanabe

(10) Patent No.: US 6,238,229 B1
(45) Date of Patent: May 29, 2001

(54) CONNECTOR

(75) Inventor: Hiroshi Watanabe, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/526,539

(22) Filed: Mar. 16, 2000

(30) Foreign Application Priority Data

Mar. 17, 1999 (JP) ..... 11-072267

(51) Int. Cl.[7] ..... H01R 13/625
(52) U.S. Cl. ..... 439/341; 439/533
(58) Field of Search ..... 439/260, 329, 439/341, 376, 527, 533, 637, 660, 729, 822

(56) References Cited

U.S. PATENT DOCUMENTS 5,598,319 * 1/1997 Lee ..... 439/131
5,833,482 * 11/1998 Buchter ..... 439/376

FOREIGN PATENT DOCUMENTS 10-302909 11/1998 (JP) ..... H01R/23/00

* cited by examiner

*Primary Examiner*—Khiem Nguyen
(74) *Attorney, Agent, or Firm*—Sughrue, Mion, Zinn, Macpeak & Seas, PLLC

(57) ABSTRACT

A bracket (40) supports an opening-closing connector (20) in a manner to allow this connector to move upward, downward, right and left before a housing (31) of a block connector (30) is held by the opening-closing connector (20). Therefore, when the housing (31) of the block connector (30) is to be inserted between housings (21, 22) of the opening-closing connector (20), the opening-closing connector (20) can be easily positioned relative to the block connector (30). After the housing (31) of the block connector (30) is held by the opening-closing connector (20), the bracket (40) is fixedly secured to the block connector (30) by bolts passing respectively through through holes (42) formed respectively through lock plates (41). Therefore, the connected condition of the connector (10) is maintained simultaneously when the connector (10) is fixed to an auxiliary equipment (33).

8 Claims, 5 Drawing Sheets

CONNECTOR

BACKGROUND OF THE INVENTION

1. Field of the Invention

The present invention relates to a connector used for connecting wire harnesses together, and more particularly to a connector of the type in which an insertion force, required for connecting connectors together, is quite low, and besides the connecting operation can be effected easily.

The present application is based on Japanese Patent Application No. Hei. 11-72267, which is incorporated herein by reference.

2. Description of the Related Art

FIG. 7 shows a related low-insertion force connector 50 disclosed in Unexamined Japanese Patent Publication No. Hei. 10-302909. A housing 71 of a block connector 70 is held between a pair of housings 61 of an opening-closing connector 60, so that electrical contact portions 62*a* of terminals 62, exposed to inner surfaces of the housings 61 of the opening-closing connector 60, are contacted respectively with electrical contact portions 72*a* of terminals 72 exposed to outer surfaces of the housing 71 of the block connector 70, thereby electrically connecting the two connectors together.

Thus, the opening-closing connector 60 and the block connector 70 are connected together by holding the housing 71 of the block connector 70 between the housings 61 of the opening-closing connector 60, and any inserting or fitting operation, involving a sliding movement between the two connectors, is not required.

When an inserting or fitting operation, involving a sliding movement between the two connectors, is effected, a predetermined insertion force is required for connecting the two connectors together since there is involved the friction due to the sliding movement between the two connectors.

However, in the low-insertion force connector 50 of FIG. 7, the required insertion force is extremely low since any inserting or fitting operation, involving a sliding movement between the two connectors, is not necessary.

In this low-insertion force connector 50, the housing 71 of the block connector 70 is held between the housings 61 of the opening-closing connector 60, and the housings 61 of the opening-closing connector 60 are held in a closed condition, so that the electrical contact portions 62*a* of the terminals 62 are contacted with the electrical contact portions 72*a* of the terminals 72, respectively, thereby electrically connecting the opening-closing connector 60 and the block connector 70 together. Then, lock claws 73, formed on the housing 71 of the block connector 70, are engaged respectively in lock frames 63 formed on the housings 61 of the opening-closing connector 60, thereby holding the opening-closing connector 60 and the block connector in a mutually-connected condition.

Thereafter, the opening-closing connector 60 and the block connector 70 are fixedly secured or fastened to an auxiliary equipment (not shown) by bolts (not shown) or the like.

In the above low-insertion force connector 50, in addition to the lock frames 63 and the lock claws 73 for holding the opening-closing connector 60 and the block connector 70 in the mutually-connected condition, fastening means (not shown), such as bolts and lock plates, for fastening the connectors 60 to 70 to the auxiliary equipment are required. Therefore, the construction becomes complicated, and the number of the component parts increases, which has invited a problem that the cost increases.

The operation for connecting the opening-closing connector 60 and the block connector 70 together, the operation for holding the two connectors 60 and 70 in the mutually-connected condition, and the operation for fastening the connectors 60 and 70 to the auxiliary equipment must be carried out sequentially separately from each other. Therefore, the time and labor, required for the connector-connecting operation, as well as the number of the component parts, increase, which has resulted in a problem that it is difficult to enhance the operation efficiency and to reduce the cost.

SUMMARY OF THE INVENTION

It is an object of this invention to provide a connector in which the time and labor, required for a connector-connecting operation, as well as the number of component parts, can be reduced, thereby achieving the enhancement of the operation efficiency and the reduction of the cost.

To achieve the above object, according to the first aspect of the present invention, there is provided a connector which comprises an opening-closing connector including at least one pair of housings which are connected together through a hinge so that the housings are able to be opened and closed, and a terminal which is provided in at least one of the pair of housings, and is exposed from an inner surface of the one housing, a block connector including a housing, which can be held between the housings of the opening-closing connector, and is fixed at its proximal end to a predetermined member, and a terminal exposed from an outer surface of the housing, wherein when the housings of the opening-closing connector are in a closed condition, the housing of the block connector is held between the housings of the opening-closing connector, and the terminal of the block connector is contacted with the terminal of the opening-closing connector, and a bracket that, before the housing of the block connector is held by the opening-closing connector, supports the opening-closing connector in a manner to allow the opening-closing connector to move in a predetermined direction, and that is fixedly secured to the predetermined member, to which the proximal end of the housing of the block connector is fixed, after the housing of the block connector is held by the opening-closing connector.

According to the second aspect of the present invention, it is preferable that a plurality of tapering surfaces are formed on a distal end portion of the housing of the block connector, and extend in a direction of insertion between the housings of the opening-closing connector, and the connector further comprises a stopper is formed on an inner surface of one of the housings of the opening-closing connector at one end portion thereof at which the hinge is formed, wherein when the housing of the block connector is inserted between the housings of the opening-closing connector, the stopper is brought into sliding contact with the tapering surfaces of the block connector, and when the housings of the opening-closing connector are opened, the stopper is abutted at its distal end against an inner surface of the other one of the housings of the opening-closing connector, thereby holding the housings of the opening-closing connector in a predetermined open condition, and when the stopper slides relative to the tapering surfaces of the block connector, abutting engagement of the stopper with the inner surface of the other housing of the opening-closing connector is canceled.

According to the third aspect of the present invention, it is preferable that the bracket supports the opening-closing connector in a manner to allow the opening-closing connector to move upward, downward, right and left relative to the direction of insertion of the housing of the block connector between the housings of the opening-closing connector, before the housing of the block connector is held between the housings of the opening-closing connector.

According to the fourth aspect of the present invention, it is preferable that the above-described connector further comprises pins projecting from outer surfaces of the hinge of the opening-closing connector, and extending along an imaginary line which is a central axis of opening-closing movement of the housings thereof, wherein the bracket includes at least one pair of support portions spaced from each other, and a distance between the support portions is longer than a distance between the outer surfaces of the hinge of the opening-closing connector, and the support portions have support grooves respectively supporting the pins in a manner to allow rotation of the pins and to allow the movement of the pins in a direction substantially perpendicular to the direction of facing of the support portions.

In the connector of the present invention, when the opening-closing connector and the block connector are to be connected together, the housing of the block connector is inserted between the housings of the opening-closing connector held in the open condition. The opening-closing connector is supported by the bracket so as to move in the predetermined direction before the housing of the block connector is held by the opening-closing connector, and therefore the position of the opening-closing connector relative to the block connector can be easily adjusted.

Then, the housings of the opening-closing connector are closed, so that the housing of the block connector is held between the housings of the opening-closing connector. As a result, the terminals, exposed to the inner surface of at least one of the housings of the opening-closing connector, are contacted respectively with the terminals exposed to the outer surface of the housing of the block connector. As a result, the opening-closing connector and the block connector are electrically connected together.

Then, the bracket is fixedly secured to the predetermined member to which the proximal end of the housing of the block connector is fixed. As a result, the opening-closing connector and the block connector are fixed to the predetermined member, and besides the electrical connection between the opening-closing connector and the block connector is maintained.

In the connector of the present invention, when the housings of the opening-closing connector are opened, the distal end of the stopper is abutted against the inner surface of the other housing of the opening-closing connector, thereby holding the housings of the opening-closing connector in the open condition.

When the opening-closing connector and the block connector are to be connected together, the housing of the block connector is inserted between the housings of the opening-closing connector held in the open condition.

The opening-closing connector is supported by the bracket so as to be moved in the predetermined direction before the housing of the block connector is held by the opening-closing connector, and therefore the position of the opening-closing connector relative to the block connector can be easily adjusted.

When the housing of the block connector is inserted between the housings of the opening-closing connector, the stopper is brought into sliding contact with the tapering surface of the block connector, so that the abutting engagement of the stopper with the inner surface of the other housing is canceled. As a result, the holding of the open condition of the housings of the opening-closing connector by the stopper is canceled, so that the housings of the opening-closing connector can be closed.

Then, the housings of the opening-closing connector are closed to hold the housing of the block connector therebetween. At a result, the terminals, exposed to the inner surface of at least one of the housings of the opening-closing connector, are contacted respectively with the terminals exposed to the outer surface of the housing of the block connector. As a result, the opening-closing connector and the block connector are electrically connected together.

Then, the bracket is fixedly secured to the predetermined member to which the proximal end of the housing of the block connector is fixed. As a result, the opening-closing connector and the block connector are fixed to the predetermined member, and besides the electrical connection between the opening-closing connector and the block connector is maintained.

In the connector of the present invention, when the opening-closing connector and the block connector are to be connected together, the housing of the block connector is inserted between the housings of the opening-closing connector held in the open condition. The opening-closing connector is supported by the bracket so as to move upward, downward, right and left relative to the direction of insertion of the housing of the block connector between the housings of the opening-closing connector before the housing of the block connector is held by the opening-closing connector. Therefore, the position of the opening-closing connector relative to the block connector can be easily adjusted.

Then, the housings of the opening-closing connector are closed to hold the housing of the block connector therebetween. At a result, the terminals, exposed to the inner surface of at least one of the housings of the opening-closing connector, are contacted respectively with the terminals exposed to the outer surface of the housing of the block connector. As a result, the opening-closing connector and the block connector are electrically connected together.

Then, the bracket is fixedly secured to the predetermined member to which the proximal end of the housing of the block connector is fixed. As a result, the opening-closing connector and the block connector are fixed to the predetermined member, and besides the electrical connection between the opening-closing connector and the block connector is maintained.

In the connector of the present invention, when the opening-closing connector and the block connector are to be connected together, the housing of the block connector is inserted between the housings of the opening-closing connector held in the open condition.

The opening-closing connector is supported by the bracket so as to move in the predetermined direction before the housing of the block connector is held by the opening-closing connector, and therefore the position of the opening-closing connector relative to the block connector can be easily adjusted. More specifically, the pins, projecting from the outer surfaces of the hinges of the housings of the opening-closing connector, are supported or received respectively in the support grooves, formed respectively in the support portions of the bracket, so as to rotate and to move in a direction substantially perpendicular to the direction of facing of the support portions. Therefore, the opening-closing connector can be moved relative to the bracket in the predetermined directions.

Then, the housings of the opening-closing connector are closed to hold the housing of the block connector therebetween. At a result, the terminals, exposed to the inner surface of at least one of the housings of the opening-closing connector, are contacted respectively with the terminals exposed to the outer surface of the housing of the block connector. As a result, the opening-closing connector and the block connector are electrically connected together.

Then, the bracket is fixedly secured to the predetermined member to which the proximal end of the housing of the block connector is fixed. As a result, the opening-closing connector and the block connector are fixed to the predetermined member, and besides the electrical connection between the opening-closing connector and the block connector is maintained.

DETAILED DESCRIPTION OF THE PREFERRED EMBODIMENT

Figure 1:
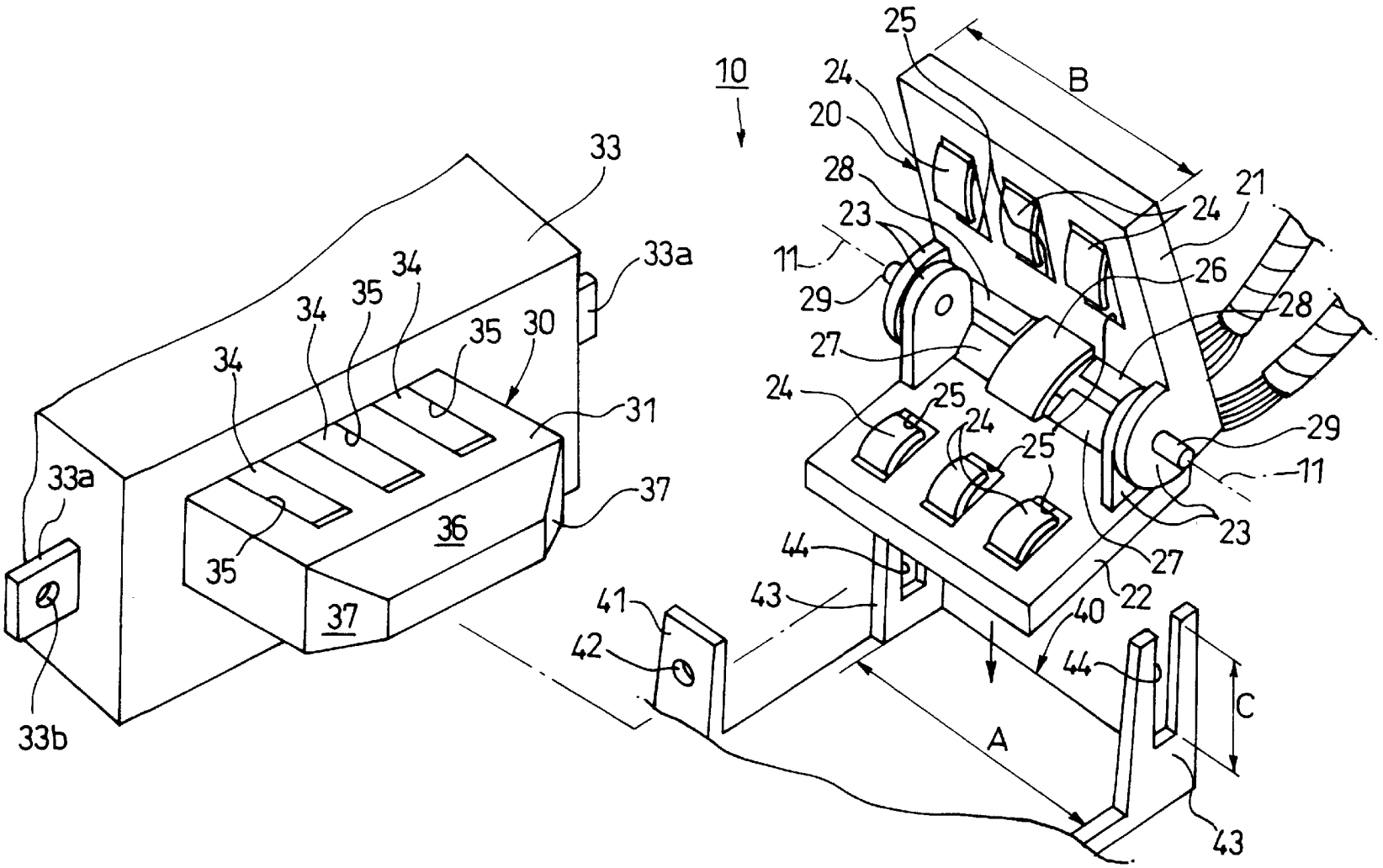
FIG. 1 is an exploded, perspective view of one preferred embodiment of a connector of the present invention.

A preferred embodiment of the present invention will now be described with reference to FIGS. 1 to 6. In FIGS. 1 to 6, the connector 10 comprises the opening-closing connector 20, and the block connector 30 to be connected to an auxiliary equipment. The opening-closing connector 20 is supported on the bracket 40 for movement in an upward-downward direction and in a right-left direction (FIG. 4), and this connector 20 comprises the pair of upper and lower housings 21 and 22 (FIG. 2) for holding the housing 31 of the block connector 30 therebetween. Therefore, terminals 24, exposed to inner surfaces of the housings 21 and 22 of the opening-closing connector 20, are contacted respectively with terminals 34, exposed to outer surfaces of the housing 31 of the block connector 30, thereby electrically connecting the opening-closing connector 20 and the block connector 30 together.

The pair of upper and lower housings 21 and 22 (FIG. 2) of the opening-closing connector 20 are connected together through the hinges 23 so as to be opened and closed. The plurality terminals 24 are provided on each of the two housings 21 and 22 (In this embodiment, three terminals 24 on each housing 21, 22, and hence six terminals 24 in all), and project a predetermined distance from the inner surface of the housing 21, 22 respectively through terminal windows 25 formed in this inner surface. Each of the terminals 24 comprises a resilient, sheet-like electrical contact member. The stopper 26 is formed on and projects from the inner surface of the lower housing 22 (FIG. 1) at one end thereof at which the hinges 23 are formed, the stopper 26 being disposed generally centrally of the width of the lower housing 22. When the housing 31 of the block connector 30 is inserted between the two housings 21 and 22 of the opening-closing connector 20, the stopper 26 is brought into sliding contact with an inner surface of a stopper-fitting groove 32 (FIG. 6) formed in the housing 31 of the block connector 30.

Figure 2:
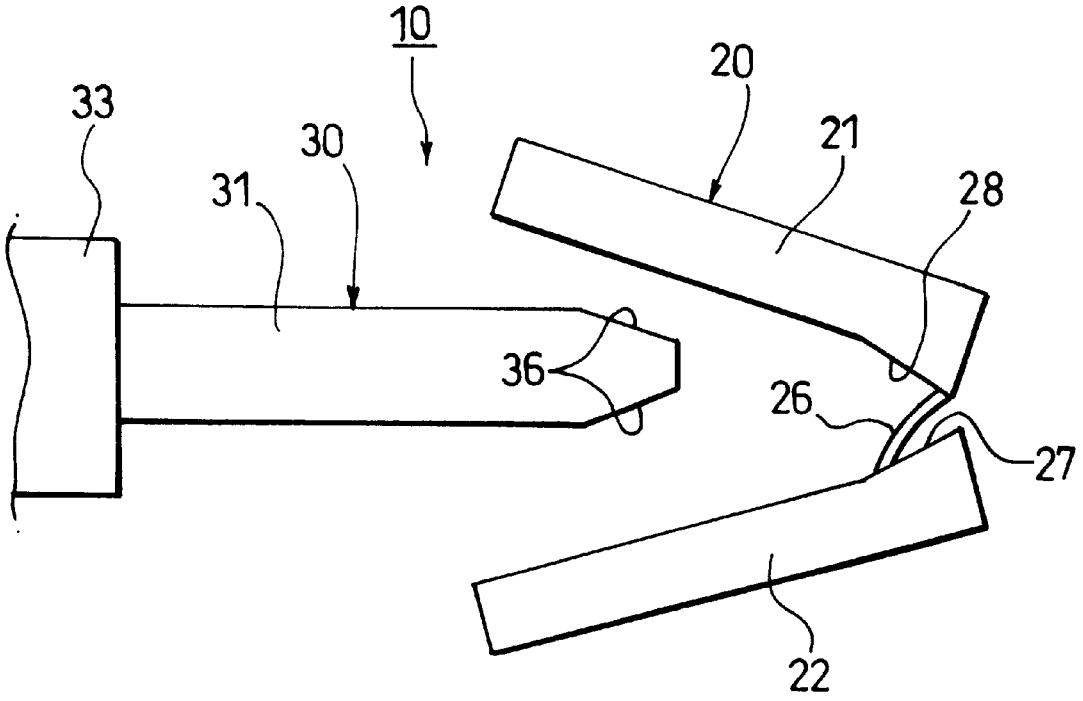
FIG. 2 is a schematic, side-elevational view showing the process of connecting connectors of FIG. 1 together.
Figure 3:
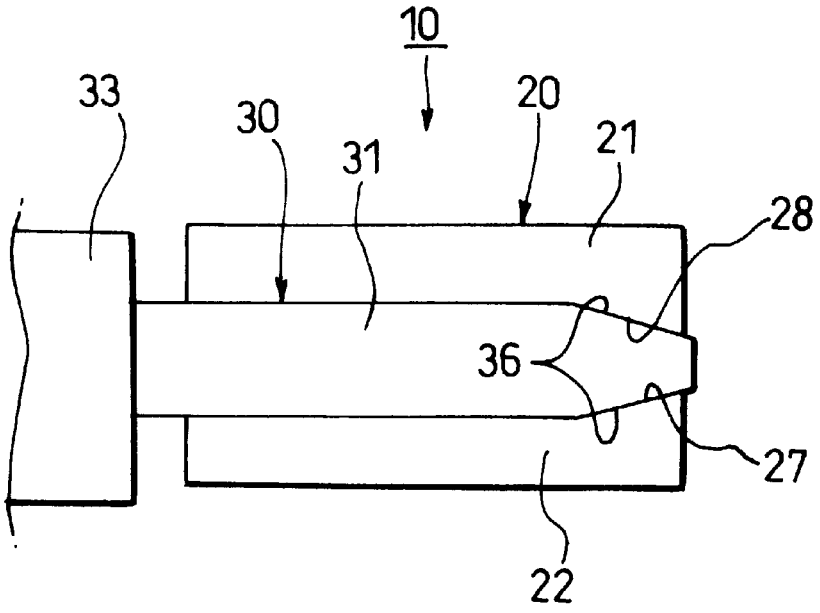
FIG. 3 is a schematic, side-elevational view showing a condition in which the connectors of FIG. 1 are connected together.

The stopper 26 is abutted at its distal end (right end in FIG. 2) against the inner surface of the upper housing 21 (FIG. 2) of the opening-closing connector 20, thereby holding the two housings 21 and 22 of the opening-closing connector 20 in a predetermined open condition shown in FIG. 2. As the upper surface (FIG. 2) of the stopper 26 slides relative to the inner surface of the stopper-fitting groove 32 in the housing 31 of the block connector 30, the abutting engagement of the stopper 26 with the inner surface of the upper housing 21 is canceled, so that the two housings 21 and 22 of the opening-closing connector 20 can be displaced or moved into a predetermined closed condition shown in FIG. 3.

The lower slanting surfaces 27 are formed on the inner surface of the lower housing 22 (FIG. 1) of the opening-closing connector 20, and are disposed on opposite sides of the stopper 26, respectively, the slanting surfaces 27 being slanting upwardly in a right-hand direction (FIG. 6) at a predetermined angle. The upper slanting surfaces 28 are formed respectively on those portions of the inner surface of the upper housing 21 (FIG. 1) to be opposed respectively to the lower slanting surfaces 27, the slanting surfaces 28 being slanting downwardly in the right-hand direction (FIG. 6) at a predetermined angle.

Figure 6:
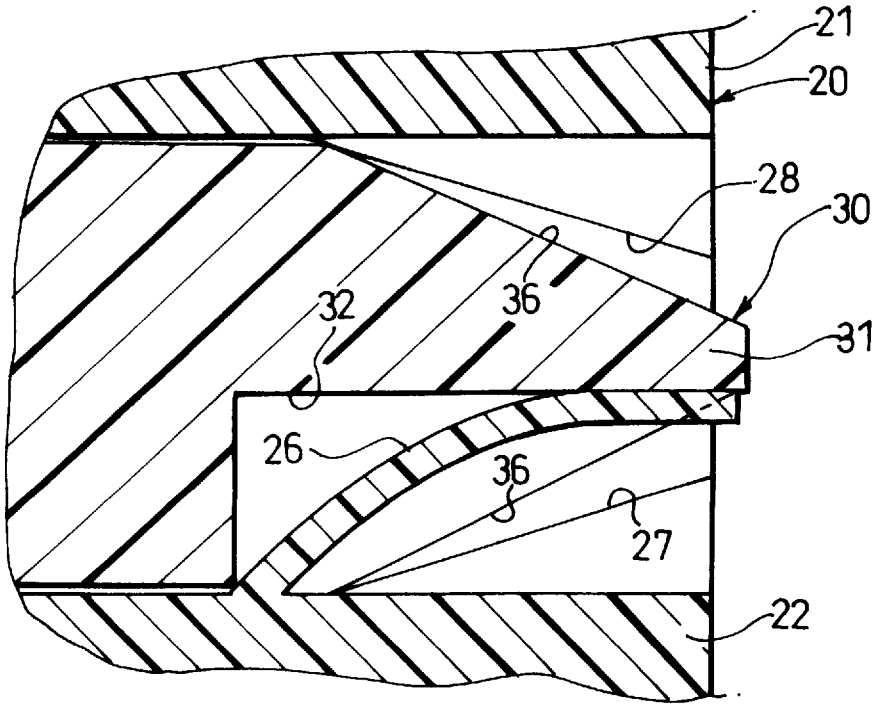
FIG. 6 is a fragmentary, cross-sectional view showing a condition in which a housing of the block connector is held between a pair of housings of the opening-closing connector.
Figure 7:
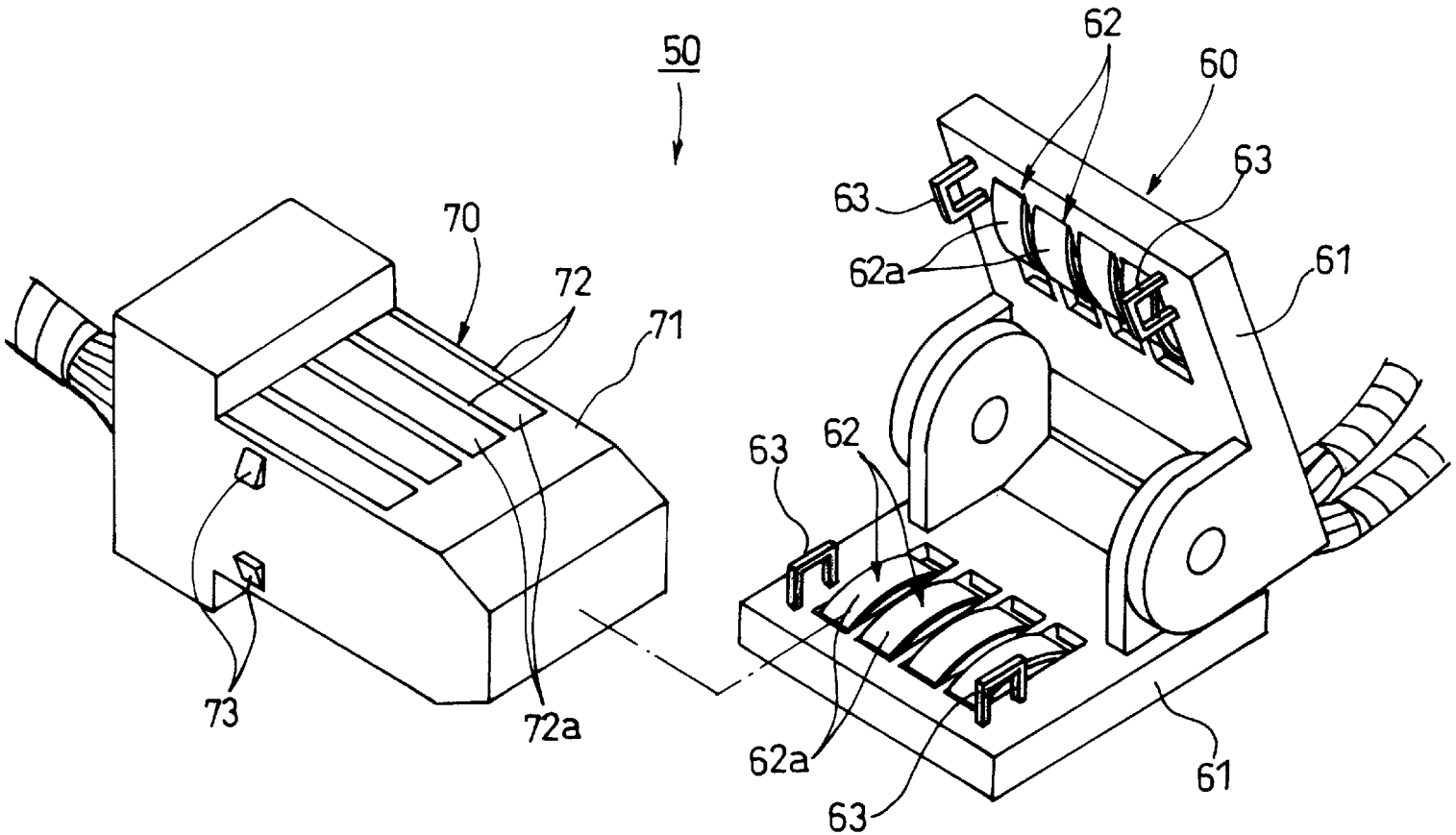
FIG. 7 PRIOR ART
FIG. 7 is a perspective view of a related low-insertion force connector.

When the housing 31 of the block connector 30 is inserted between the two housings 21 and 22 of the opening-closing connector 20 held in the predetermined open condition, the slanting surfaces 27 and 28 are brought into sliding contact with upper and lower tapering surfaces 36 and 36 (FIG. 6), formed at the distal end portion of the housing 31 of the block connector 30, so that the slanting surfaces 27 and 28, together with the stopper 26, are pressed in the inserting direction (the right-hand direction in FIG. 6). As a result, the two housings 21 and 22 of the opening-closing connector 20 are displaced toward their respective closed positions.

Pins 29 project from the outer surfaces of the hinges 23 of the housings 21 and 22 of the opening-closing connector 20, and extend along an imaginary line 11 which is the axis of opening-closing movement (pivotal movement) of the housings 21 and 22. The pins 29 are loosely fitted respectively in support grooves 44 formed respectively in support portions 43 of the bracket 40.

The block connector 30 includes the housing 31 which can be held between the two housings 21 and 22 of the opening-closing connector 20, and this housing 31 is fixed at its proximal end (left end in FIG. 2) to a predetermined member 33 (hereinafter referred to as "auxiliary equipment 33"). The plurality of terminals 34 are provided on the outer surfaces (upper and lower surfaces in FIG. 1) of the housing 31 (In this embodiment, three terminals 34 on each of the upper and lower surfaces, and hence six terminals 34 in all), and more specifically these terminals 34 are exposed to the outer surfaces (upper and lower surfaces in FIG. 1) respectively through terminal windows 25 formed in these outer surfaces. Each of these terminals 34 comprises an electrical contact member having a flat contact surface.

When the two housings 21 and 22 of the opening-closing connector 20 are closed, the housing 31 of the block connector 30 is held between these housings 21 and 22, so that the terminals 34 are contacted with the terminals 24 of the opening-closing connector 20, respectively.

The distal end portion of the housing 31 of the block connector 30 is tapering, and more specifically the upper and lower surfaces (FIG. 1) of this distal end portion are defined respectively by the tapering surfaces 36 extending in the inserting direction, and opposite side surfaces of the distal end portion are defined respectively by tapering surfaces 37 extending in the inserting direction.

The bracket 40 supports the opening-closing connector 20 in a manner to allow this connector 20 to move in upward, downward, right-hand and left-hand directions before the housing 31 of the block connector 30 is held by the opening-closing connector 20. After the housing 31 of the block connector 30 is held by the opening-closing connector 20, the bracket 40 is fixed to the block connector 30 by bolts or the like (not shown) each passing a through hole 42, formed in an associated lock plate 41, and a through hole 33*b* formed in an associated lock plate 33*a* of the block connector 30.

The bracket 40 includes the pair of support portions 43 for supporting the opening-closing connector 20, and the distance B between the pair of support portions 43 is larger a predetermined amount than the distance A between the outer surfaces of the hinges 23 of the two housings 21 and 22 of the opening-closing connector 20. Each of the support portions 43 has the generally U-shaped support groove 44 which is open upwardly (FIGS. 1 and 4), and has a depth C (in the upward-downward direction in FIGS. 1 and 4). The support grooves 44 respectively support the pins 29 of the opening-closing connector 20 in a manner to allow the rotation of the pins 29 and to allow the movement of the pins 29 in a direction (upward and downward in FIGS. 1 and 4) substantially perpendicular to the direction of facing of the two support portions 43.

Figure 4:
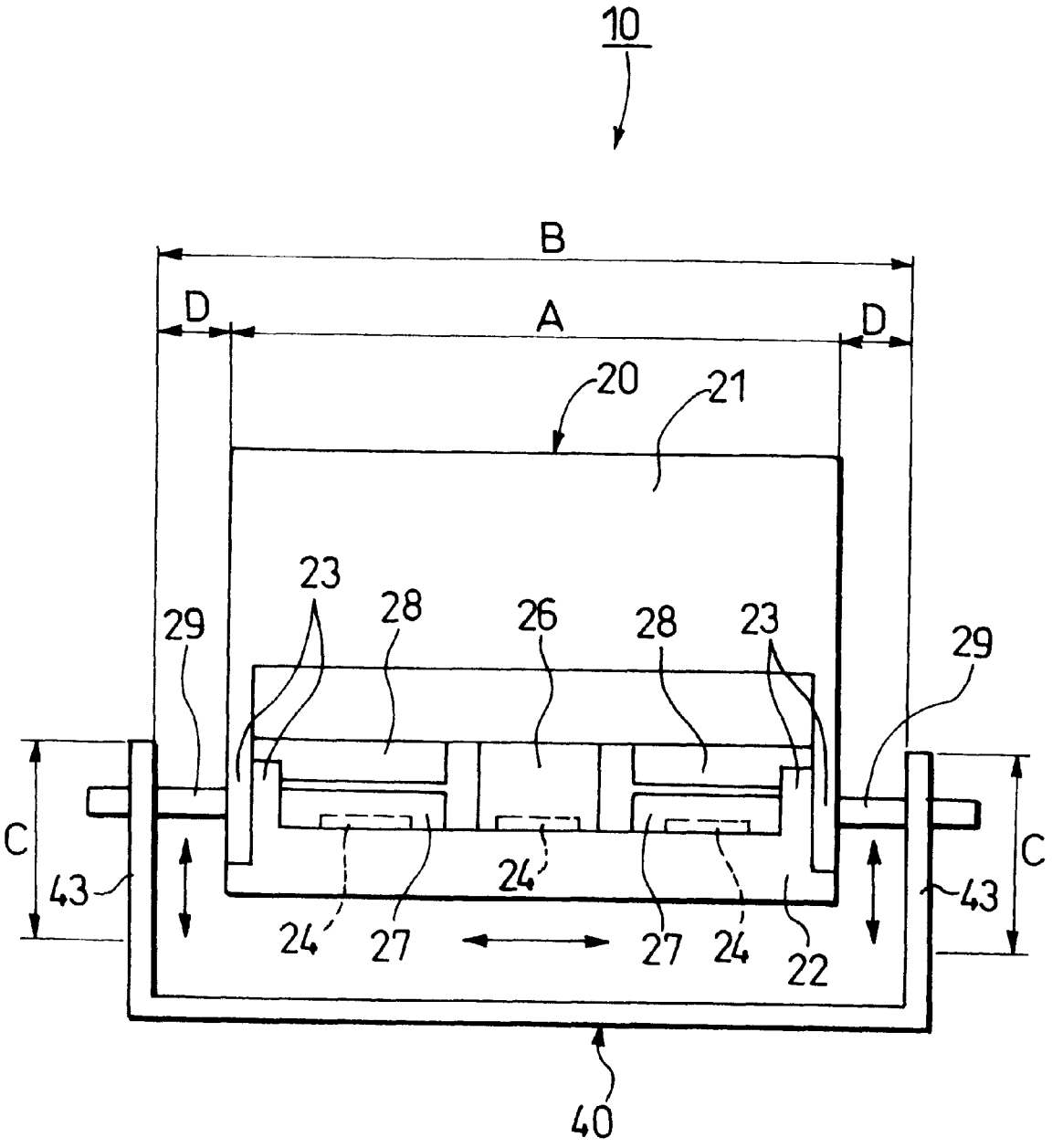
FIG. 4 is a rear view showing the opening-closing connector and a bracket.
Figure 5:
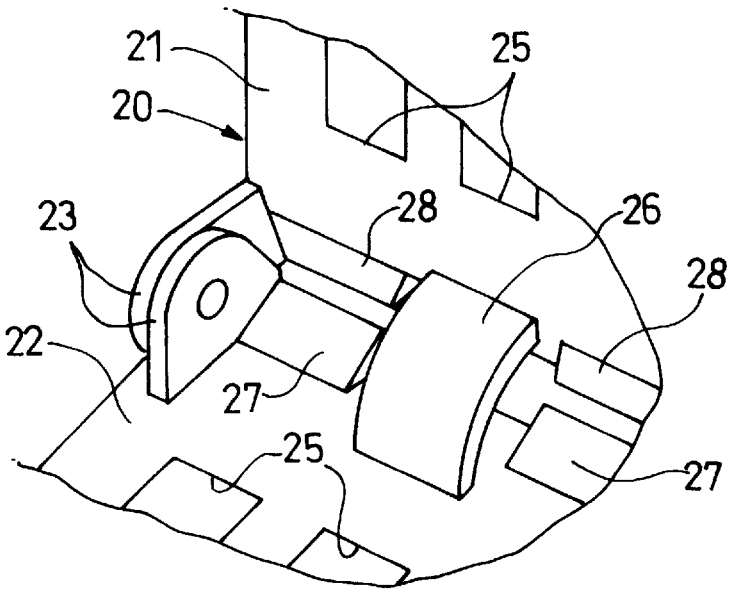
FIG. 5 is a fragmentary, perspective view showing hinges, slanting surfaces and a stopper of the opening-closing connector.

Namely, the bracket 40 supports the opening-closing connector 20 in such a manner that the opening-closing connector 20 can move a predetermined amount, corresponding to the distance D between the outer surface of the hinge 23 and the support portion 43, in the right-left direction (FIG. 4), and also can move a predetermined amount, corresponding to the depth C of the support groove 44, in the upward-downward direction (FIG. 4).

The operation of this embodiment will now be described.

When the opening-closing connector 20 and the block connector 30 are to be connected together, the pins 29, projecting from the outer surfaces of the hinges 23 of the opening-closing connector 20, are first loosely fitted respectively in the support grooves 44, formed respectively in the support portions 43 of the bracket 40, from the upper side (FIG. 1). As a result, the opening-closing connector 20 is supported on the bracket 40 for movement the predetermined amount in the upward, downward, right and left directions (FIG. 4).

Then, the housing 31 of the block connector 30, fixed to the auxiliary equipment 33, is inserted between the two housings 21 and 22 of the opening-closing connector 20, held in the predetermined open condition (FIG. 2) by the stopper 26, from the left side (FIG. 2).

At this time, the opening-closing connector 20 can be easily positioned relative to the block connector 30 since the opening-closing connector 20 can be moved relative to the bracket 40 in the upward, downward, right and left directions (FIG. 4). More specifically, the tapering surfaces (upper and lower surfaces in FIG. 6) 36 of the housing 31 of the block connector 30 are brought into engagement with the inner surfaces of the two housings 21 and 22 of the opening-closing connector 20 while the tapering surfaces (opposite side surfaces in FIG. 6) 37 of the housing 31 are brought into engagement with the inner surfaces of the hinges 23, and therefore the position of the opening-closing connector 20 relative to the block connector 30 can be easily adjusted.

The stopper 26 is brought into sliding contact with the inner surface of the stopper-fitting groove 32 in the housing 31 of the block connector 30, and as a result the stopper 26 is disengaged from the inner surface of the upper housing 21 (FIG. 1) of the opening-closing connector 20, and the slanting surfaces 27 and 28 of the opening-closing connector 20 are brought into sliding contact with the tapering surfaces (upper surfaces) 36 of the housing 31 of the block connector 30. As a result, the two housings 21 and 22 are displaced into their respective closed positions, and hence are disposed in the closed condition shown in FIG. 3.

In the closed condition of the two housings 21 and 22 of the opening-closing connector 20, the housing 31 of the block connector 30 is held between the two housings 21 and 22 of the opening-closing connector 20. Therefore, the terminals 34 in the housing 31 of the block connector 30 are contacted respectively with the terminals 24 in the two housings 21 and 22 of the opening-closing connector 20, thereby electrically connecting the opening-closing connector 20 and the block connector 30 together.

Thereafter, the bracket 40 is fixedly secured to the auxiliary equipment 33 by bolts or the like (not shown). More specifically, the through hole 42 in each lock plate 41, formed on the bracket 40, is aligned with the through hole 33*b* in the associated lock plate 33*a* formed on the auxiliary equipment 33, and then the bolt is passed through the aligned through holes 42 and 33*b*, thereby fixedly securing the bracket 40 to the auxiliary equipment 33. As a result, the connector 10 is fixed to the auxiliary equipment 33, and also the connected condition of the connector 10 is maintained.

In the above embodiment, the opening-closing connector 20 can be moved relative to the bracket 40 in the upward, downward, right and left directions (FIG. 4), and therefore when the housing 31 of the block connector 30 is to be inserted between the two housings 21 and 22 of the opening-closing connector 20, the positioning of the opening-closing connector 20 relative to the block connector 30 can be easily effected. Therefore, the time and labor, required for the connector-connecting operation, can be reduced, so that the efficiency of the operation can be enhanced.

After the opening-closing connector 20 and the block connector 30 are connected together, the bracket 40 is fixedly secured to the auxiliary equipment 33 by bolts or the like. By doing so, the connected condition of the connector 10 can be maintained simultaneously when fixing the connector 10 to the auxiliary equipment 33. Therefore, the time and labor, required for the connector-connecting operation, can be reduced, so that the efficiency of the operation can be enhanced, and besides the number of the component parts can be reduced, so that the cost can be reduced.

When the two housings 21 and 22 of the opening-closing connector 20 are opened, the stopper 26, formed on and projecting from the lower housing 22 (FIG. 1) of the opening-closing connector 20, is abutted at its distal end with the inner surface of the upper housing 21 (FIG. 1) to hold the two housings 21 and 22 in the predetermined open condition. As the stopper 26 slides relative to the tapering surface 36 of the block connector 30, the abutting engagement of the stopper 26 with the upper housing 21 is canceled.

Therefore, in the connector-connecting operation, the two housings 21 and 22 of the opening-closing connector 20 can be positively held in the predetermined open condition by the stopper 26, so that the efficiency of the operation can be enhanced. And besides, any special operation is not required for closing the two housings 21 and 22 of the opening-closing connector 20. Namely, merely by inserting the housing 31 of the block connector 30 between the two housings 21 and 22 of the opening-closing connector 20 held in the open condition, the holding of the open condition of the housings 21 and 22 by the stopper 26 can be canceled.

In the above embodiment, although the terminals 24 are exposed to the inner surfaces of the two housings 21 and 22 of the opening-closing connector 20, the terminals 24 may be provided on at least one of the two housings 21 and 22.

As described above, in the present invention, the bracket supports the opening-closing connector in a manner to allow the opening-closing connector to move in the predetermined directions before the housing of the block connector is held by the opening-closing connector. After the housing of the block connector is held by the opening-closing connector, the bracket is fixedly secured to the predetermined member to which the proximal end of the housing of the block connector is fixed. Therefore, the time and labor, required for the connector-connecting operation, as well as the number of the component parts, can be reduced. Therefore, the efficiency of the operation, as well as the cost, can be reduced.

The stopper is formed on the inner surface of one of the housings of the opening-closing connector at one end portion thereof at which the hinges are formed. When the housings of the opening-closing connector are opened, the stopper is abutted at its distal end with the inner surface of the other housing of the opening-closing connector, thereby holding the housings of the opening-closing connector in the predetermined open condition. When the stopper slides relative to the tapering surface of the block connector, the abutting engagement of the stopper with the inner surface of the other housing of the opening-closing connector is canceled.

Therefore, in the connector-connecting operation, the housings of the opening-closing connector can be positively held in the predetermined open condition by the stopper, so that the efficiency of the operation can be enhanced. And besides, any special operation is not required for closing the housings of the opening-closing connector. Namely, merely by inserting the housing of the block connector between the housings of the opening-closing connector held in the open condition, the holding of the open condition of the housings by the stopper can be canceled.

In the present invention, the bracket supports the opening-closing connector in a manner to allow this connector to move upward, downward, right and left relative to the direction of insertion of the housing of the block connector between the housings of the opening-closing connector before the housing of the block connector is held between the opening-closing connector. After the housing of the block connector is held by the opening-closing connector, the bracket is fixedly secured to the predetermined member to which the proximal end of the housing of the block connector is fixed. Therefore, the time and labor, required for the connector-connecting operation, as well as the number of the component parts, can be reduced, and therefore the enhancement of the operation efficiency as well as the reduction of the cost can be achieved.

In the present invention, the pins, projecting from the outer surfaces of the hinges of the housings of the opening-closing connector, are supported -or received respectively in the support grooves, formed respectively in the support portions of the bracket, so as to rotate and to move in a direction substantially perpendicular to the direction of facing of the support portions. Thus, the bracket supports the opening-closing connector in a manner to allow this connector to move in the predetermined directions before the housing of the block connector is held by the opening-closing connector. After the housing of the block connector is held by the opening-closing connector, the bracket is fixedly secured to the predetermined member to which the proximal end of the housing of the block connector is fixed. Therefore, the time and labor, required for the connector-connecting operation, as well as the number of the component parts, can be reduced. Therefore, the enhancement of the operation efficiency as well as the reduction of the cost can be achieved.

What is claimed is:

1. A connector, comprising:

an opening-closing connector including at least one pair of housings which are connected together through a hinge so that the housings are able to be opened and closed, and a terminal which is provided in at least one of the pair of housings, and is exposed from an inner surface of the one housing;

a block connector including a housing, which can be held between the housings of the opening-closing connector, and is fixed at its proximal end to a predetermined member, and a terminal exposed from an outer surface of the housing, wherein when the housings of the opening-closing connector are in a closed condition, the housing of the block connector is held between the housings of the opening-closing connector, and the terminal of the block connector is contacted with the terminal of the opening-closing connector; and a bracket that, before the housing of the block connector is held by the opening-closing connector, supports the opening-closing connector in a manner to allow the opening-closing connector to move in a predetermined direction, and that is fixedly secured to the predetermined member, to which the proximal end of the housing of the block connector is fixed, after the housing of the block connector is held by the opening-closing connector.

2. A connector according to claim 1, wherein a plurality of tapering surfaces are formed on a distal end portion of the housing of the block connector, and extend in a direction of insertion between the housings of the opening-closing connector, and the connector further comprises a stopper is formed on an inner surface of one of the housings of the opening-closing connector at one end portion thereof at which the hinge is formed, wherein when the housing of the block connector is inserted between the housings of the opening-closing connector, the stopper is brought into sliding contact with the tapering surfaces of the block connector, and when the housings of the opening-closing connector are opened, the stopper is abutted at its distal end against an inner surface of the other one of the housings of the opening-closing connector, thereby holding the housings of the opening-closing connector in a predetermined open condition, and when the stopper slides relative to the tapering surfaces of the block connector, abutting engagement of the stopper with the inner surface of the other housing of the opening-closing connector is canceled.

3. A connector according to claim 1, wherein the bracket supports the opening-closing connector in a manner to allow the opening-closing connector to move upward, downward, right and left relative to the direction of insertion of the housing of the block connector between the housings of the opening-closing connector, before the housing of the block connector is held between the housings of the opening-closing connector.

4. A connector according to claim 2, wherein the bracket supports the opening-closing connector in a manner to allow the opening-closing connector to move upward, downward, right and left relative to the direction of insertion of the housing of the block connector between the housings of the opening-closing connector, before the housing of the block connector is held between the housings of the opening-closing connector.

5. A connector according to claim 1, further comprising pins projecting from outer surfaces of the hinge of the opening-closing connector, and extending along an imaginary line which is a central axis of opening-closing movement of the housings thereof, wherein the bracket includes at least one pair of support portions spaced from each other, and a distance between the support portions is longer than a distance between the outer surfaces of the hinge of the opening-closing connector, and the support portions have support grooves respectively supporting the pins in a manner to allow rotation of the pins and to allow the movement of the pins in a direction substantially perpendicular to the direction of facing of the support portions.

6. A connector according to claim 2, further comprising pins projecting from outer surfaces of the hinge of the opening-closing connector, and extending along an imaginary line which is a central axis of opening-closing movement of the housings thereof, wherein the bracket includes at least one pair of support portions spaced from each other, and a distance between the support portions is longer than a distance between the outer surfaces of the hinge of the opening-closing connector, and the support portions have support grooves respectively supporting the pins in a manner to allow rotation of the pins and to allow the movement of the pins in a direction substantially perpendicular to the direction of facing of the support portions.

7. A connector according to claim 3, further comprising pins projecting from outer surfaces of the hinge of the opening-closing connector, and extending along an imaginary line which is a central axis of opening-closing movement of the housings thereof, wherein the bracket includes at least one pair of support portions spaced from each other, and a distance between the support portions is longer than a distance between the outer surfaces of the hinge of the opening-closing connector, and the support portions have support grooves respectively supporting the pins in a manner to allow rotation of the pins and to allow the movement of the pins in a direction substantially perpendicular to the direction of facing of the support portions.

8. A connector according to claim 4, further comprising pins projecting from outer surfaces of the hinge of the opening-closing connector, and extending along an imaginary line which is a central axis of opening-closing movement of the housings thereof, wherein the bracket includes at least one pair of support portions spaced from each other, and a distance between the support portions is longer than a distance between the outer surfaces of the hinge of the opening-closing connector, and the support portions have support grooves respectively supporting the pins in a manner to allow rotation of the pins and to allow the movement of the pins in a direction substantially perpendicular to the direction of facing of the support portions.

* * * * *